US005351891A

United States Patent [19]

Hansen et al.

[11] Patent Number: 5,351,891

[45] Date of Patent: Oct. 4, 1994

[54] ROTATING HIGH-PRESSURE SPRAY HEAD AND OPTIONAL DRILL

[76] Inventors: Leno B. Hansen, 31 Thornby Avenue, Solihull, West Midlands B91 2BT, United Kingdom; Bjorn R. Hansen, Asmarkveien Soreal N-2600, Lillehammer, Norway

[21] Appl. No.: 966,032

[22] PCT Filed: Jul. 3, 1991

[86] PCT No.: PCT/GB91/01083

§ 371 Date: Dec. 24, 1992

§ 102(e) Date: Dec. 24, 1992

[87] PCT Pub. No.: WO92/00811

PCT Pub. Date: Jan. 23, 1992

[30] Foreign Application Priority Data

Jul. 3, 1990 [GB] United Kingdom ..... 9014776.0

[51] Int. Cl.[5] ..... B05B 3/06; A62C 31/05

[52] U.S. Cl. ..... 239/248; 239/251; 239/271; 239/544; 169/70

[58] Field of Search ..... 239/246, 248, 249, 251, 239/271, 288, 289, 543, 544; 169/70

[56] References Cited

U.S. PATENT DOCUMENTS

| | | | |
|---|---|---|---|
| 839,523 | 12/1906 | Taber | 239/251 |
| 1,756,582 | 4/1930 | Butler | 239/271 |
| 2,813,753 | 11/1957 | Roberts | 239/271 |
| 2,993,650 | 7/1961 | Badberg | 239/271 |
| 4,271,909 | 6/1981 | Chatfield, Jr. et al. | 169/70 |
| 4,697,740 | 10/1987 | Ivy | 239/271 |

FOREIGN PATENT DOCUMENTS

| | | |
|---|---|---|
| 917890 | 9/1954 | Fed. Rep. of Germany . |
| 2500334 | 8/1982 | France . |

*Primary Examiner*—Karen B. Merritt
*Attorney, Agent, or Firm*—Edwin D. Schindler

[57] ABSTRACT

A high-pressure water spray gun is disclosed for use, for example, for fire-fighting. The spray gun has a cylindrical body for connection to a supply hose and a spray lead rotatable in the body by water issuing through pairs of jet nozzles around the barrel of the spray head. In each pair of nozzles, the axes of the nozzles are convergent and being closest to each other in a mixing region at, or just outside of, the outer surface of the barrel. At least one nozzle has a non-radial axis. The spray head may be normally housed in the body, being moved to an exposed working position by water pressure against a spring.

15 Claims, 4 Drawing Sheets

ROTATING HIGH-PRESSURE SPRAY HEAD AND OPTIONAL DRILL

This invention relates to spray heads for converting a liquid at high pressure into an enveloping spray around the head. Such a spray head may for instance form part of a high-pressure spray gun, for example a water spray gun for extinguishing fires. The invention also relates to high-pressure spray guns incorporating such a spray head.

Many different types of spray head are known, one example being the type of garden or agricultural sprinkler that has a rotating arm having jet nozzles at its ends. The arm is rotated by water pressure so that water Is sprayed over a circular area around the sprinkler. At any given moment, a given point in this area may not be under the water, which moves in a circle.

Another type of sprinkler has a head that has jet nozzles distributed around a circumferential surface to produce a continuous water spray.

An object of the present invention is to provide a spray head, and/or a spray gun, that gives an intense spray of substantially atomised particles of water or other liquid within a space around the spray head, such as not merely to deposit the water on the ground or floor, but to fill the space to a substantial extent. This is important, in particular, in connection with fire-fighting, but the invention is not confined to such applications: it can for example find application in process industries where the above space-filling facility may be of advantage.

According to the invention in a first aspect, a spray head for converting a liquid at high pressure into an enveloping spray around the head, is characterised in that it comprises a hollow cylindrical shell having a barrel portion of circular cross section, the head having at least one bearing surface for mounting it for rotation about its axis, the head having means substantially closing it ahead of the barrel portion when so mounted, but being open axially behind the barrel portion for receiving the high-pressure liquid within the latter, the barrel portion having groups of jet orifices arranged around its circumference and formed through its wall , each group comprising at least two orifices having generally convergent axes orientated so as to be closest to each other in a mixing region at or Just outside the outer cylindrical surface of the head, and the axis of at least one orifice in each group being non-radial.

Preferably, at least one said group includes an orifice so orientated as to direct a Jet of liquid in a direction such as to cause the head to rotate about its own axis.

At least one said group preferably comprises orifices arranged to pass liquid through them at different flow rates.

According to the invention in a second aspect, a spray gun is characterised by a hollow body adapted for connection to a high pressure liquid supply, the body being open at its downstream end and having mounting means carrying a spray head according to the said first aspect of the invention, the spray head being sealingly engaged in the body.

Preferably, the spray gun has a body in the form of a cylinder or tube, connectable at its rear end to a source of a fluid under pressure and open at its front end. The spray head may then be a piston housed coaxially in the body, and spring means for biassing the piston towards the rear so that it normally lies substantially wholly within the body.

The mounting means may then be a shaft, arranged coaxially With the tube and projecting sealingly out through the front part of the piston. This shaft is rotatable in the tubular body and is hollow, projecting beyond the front end of the body and, optionally, terminating in a jet nozzle. The shaft is preferably arranged to be driven in rotation, by any suitable drive means.

The shaft can even carry at its leading end a drill of approximately the same outer diameter as the cylinder containing the piston, this drill being adapted for drilling through a wall or other part of a building by trepanning; the leading end of the hollow shaft lies within the drill.

The jet nozzles of the spray head are so arranged that the liquid forced under pressure through the nozzles exerts a resulting turning moment on the spray head so as to rotate it about the axis of the piston.

Embodiments of the invention will now be described, by way of example and with reference to the accompanying drawings, in which.

Figure 7:
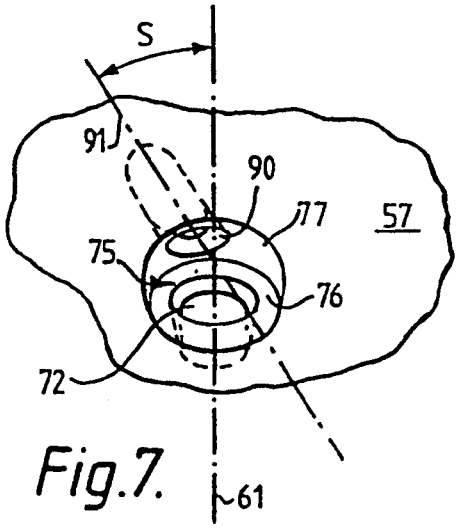
Figure 8:
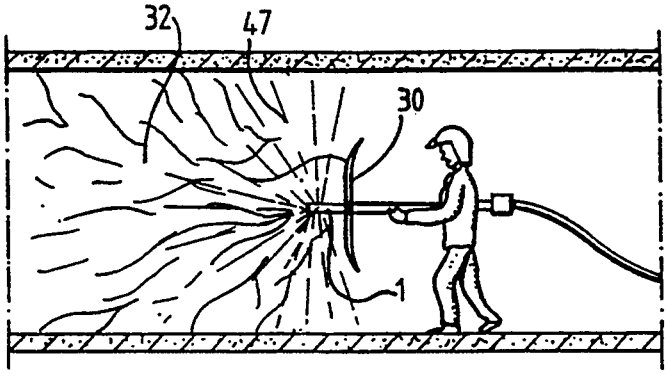
Figure 9:
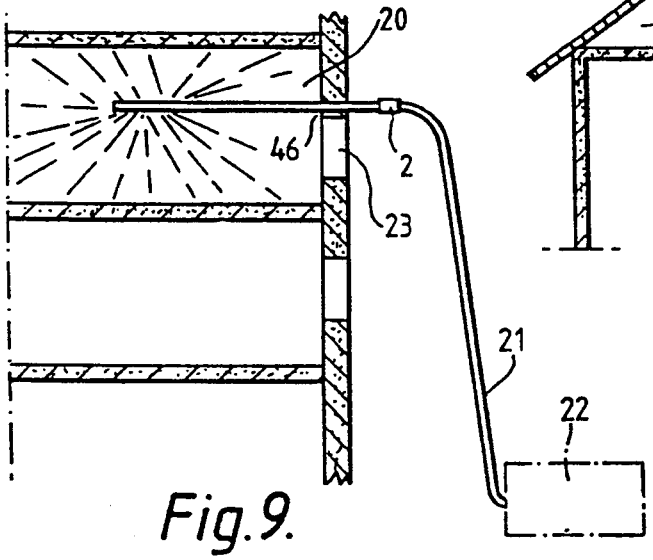
Figure 10:
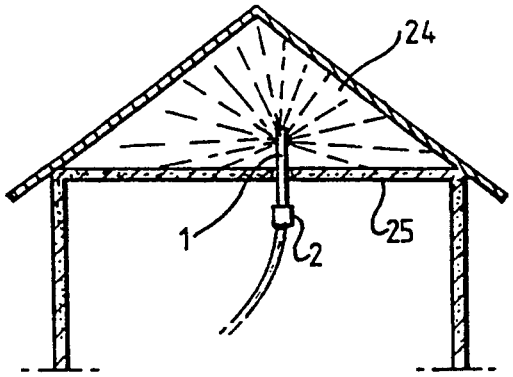
Figure 11:
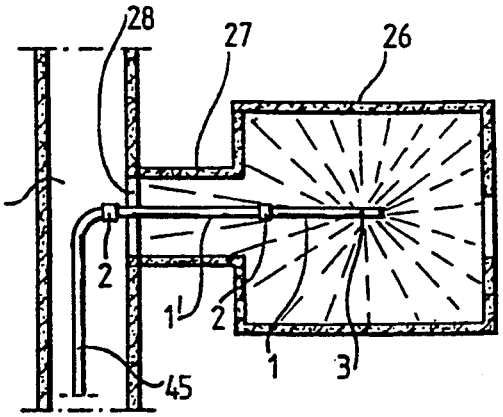
Figure 12:
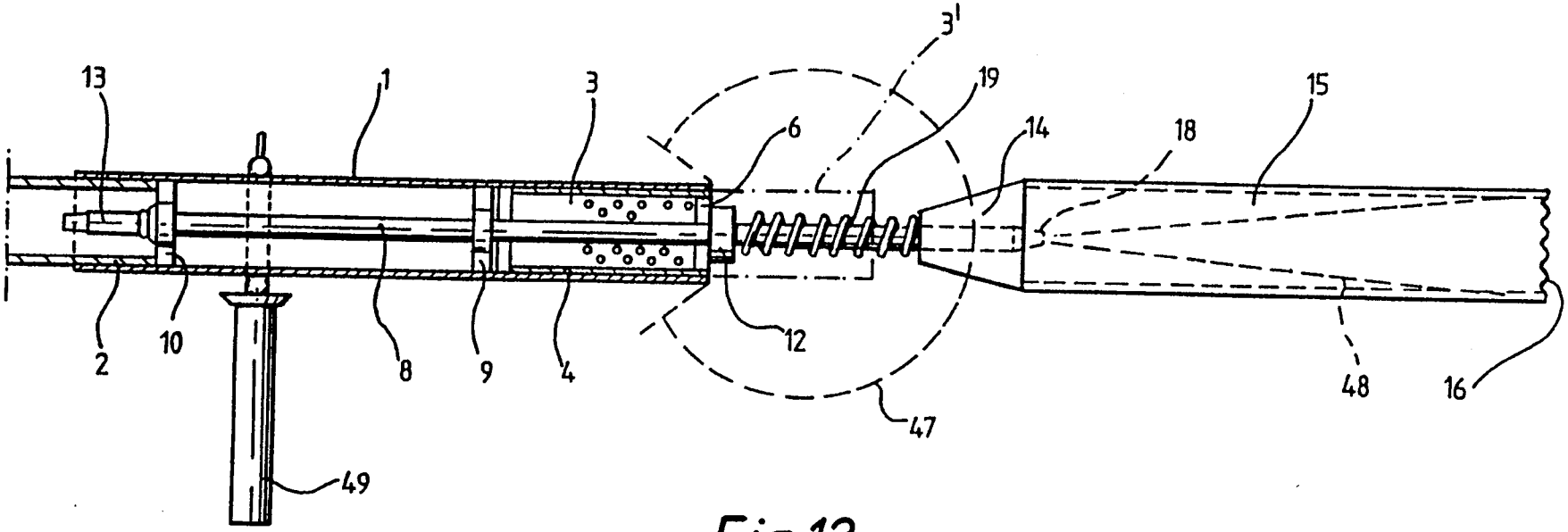

FIG. 7 an outside view, seen looking in a generally radial direction, on another pair of jet nozzles:

FIG. 8 illustrates a typical use for the spray gun;

FIGS. 9 to 11 show typical uses for the spray gun when modified by the addition of a trepanning drill; and FIG. 12 is a much simplified, part-sectional elevation of a fire extinguishing spray gun having such a drill.

Figure 1:
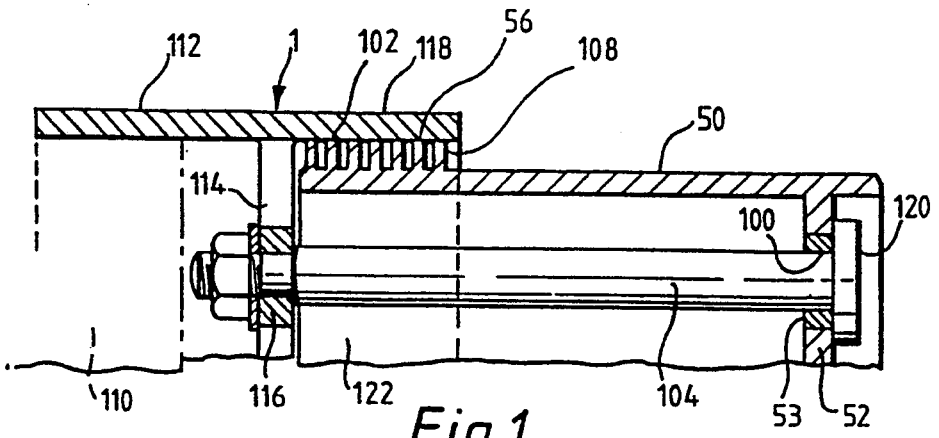
FIG. 1 is a much simplified, part sectional elevation of part of a fire extinguishing spray gun in one embodiment of the invention.

FIG. 1 shows part of a spray gun comprising a generally cylindrical body 1, with connecting means, not shown, for coupling its rear or posterior end 112 to the outlet end of a fire hose indicated in phantom lines at 110. Part-way along the body 1, a set of radial ribs 114 carries a boss 116 to which a coaxial mounting bar 104 is secured. The bar 104 projects forward through the forward or anterior end 118 of the body 1, and terminates in an end stop 120.

A spray head 50 comprises a hollow cylindrical shell closed at its front end by a radial wall 52, having a central hole 53 with a bearing surface 100 rotatably mounted on the bar 104. The posterior or near end 122 of the head 50 has an external, cylindrical bearing surface 102 carrying a labyrinth seal 56 and rotatably fitting in the bore 108 of the forward end 118 of the body 1.

Figure 2:
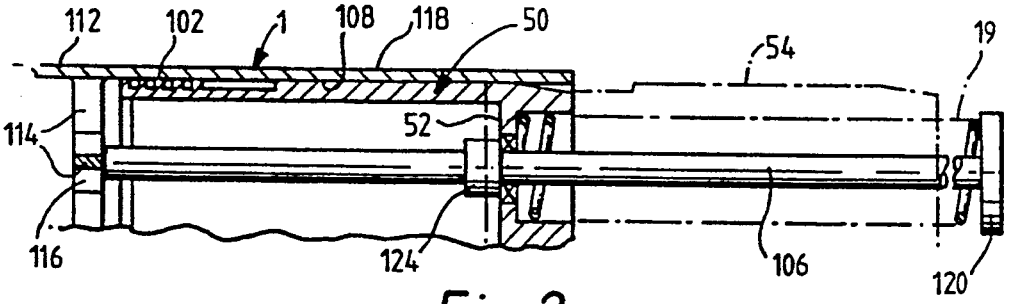
FIG. 2 is a similar view of part of a spray gun in another embodiment.

The spray gun in FIG. 2 differs from that of FIG. 1 in that the bar 104 is replaced by a longer bar 106 having a stop element 124. The forward end portion 118 of the body 1 is also elongated so that the spray head 50 lies wholly within it when in the position of the head 50 shown in full lines, which is a "parked" position. When full water pressure is applied (from the left as seen in FIG. 2), the head 50 acts as a piston and is driven partly out of the body, so that its barrel portion 54 projects from the body, with a light return spring 19 then being compressed between the spray head wall 52 and the fixed end stop 120. When the water pressure is reduced or removed, the spring 19 urges the head 50 back into the body 1 until the wall 52 comes into engagement on the stop element 124.

Figure 3:
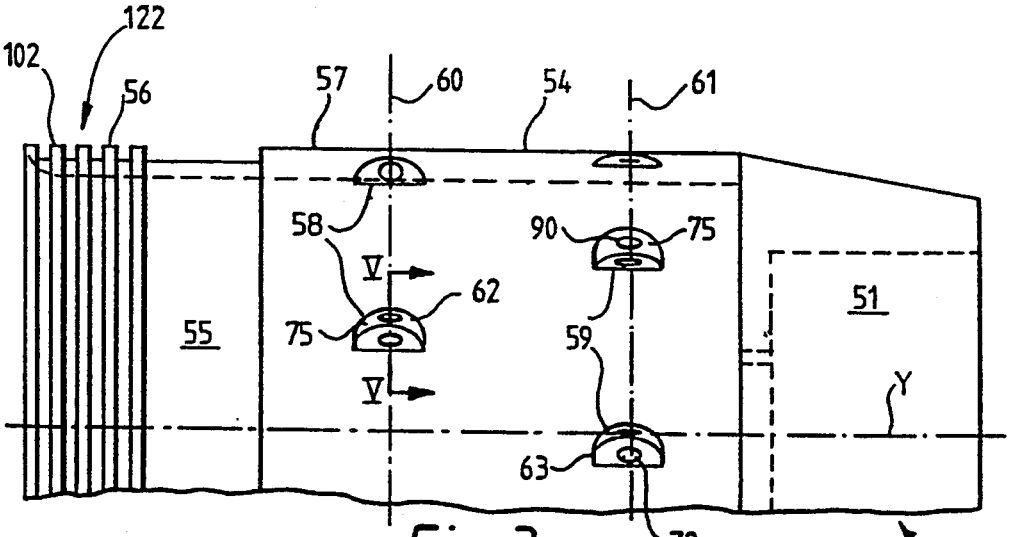
FIG. 3 is a partial elevation of a spray head comprising a piston, in one form of the invention, for incorporating in the spray gun of FIG. 2.
Figure 4:
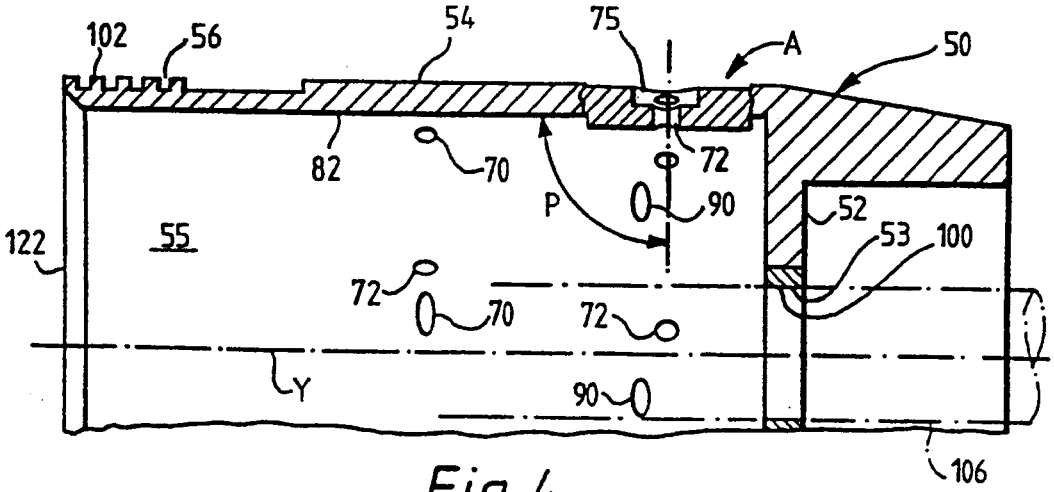
FIG. 4 is a partial view seen in diametral cross section in the same direction as FIG. 3, except for a small scrap section indicated at A in FIG. 4.

Referring now to FIGS. 3 and 4, the hollow cylindrical shell of the spray head 50 has a front end portion 51 which incorporates the transverse wall 52 with its front bearing 100. The wall 52 closes the front end of the piston , except for the central hole 53 in the wall 52 to accommodate the bar 104 or 106, FIGS. 1 and 2. Behind the portion 51, the cylindrical barrel portion 54 leads to a rear portion 55 which carries the bearing surface 102 with its external labyrinth 56, to reduce the pressure drop along the outside of the piston within the body 1, in which the outer cylindrical surface 57 of the barrel 54 is a snug sliding and rotating fit.

The barrel 54 has groups of jet orifices (referred to in the rest of this description as "nozzles", for convenience), which are arranged around its circumference, extending through the barrel wall. These groups may be disposed in any desired way, but in this example they are arranged in two sets, namely a rear set 58 and a front set 59, the groups of nozzles in each set having the same relationship to a respective diametral plane 60, 61. The rear set 58 consists of eight groups 62 of nozzles, equally spaced circumferentially. The front set also consists of eight groups 63 of nozzles, again equally spaced circumferentially but offset circumferentially by 22 ½ degrees from the groups 62. Each of the groups 62, 63 is in fact a pair of nozzles in this example.

One of the nozzle pairs 62 will now be described with reference to FIGS. 5 and 6. It comprises a first cylindrical nozzle 70 having an axis 71 and a second cylindrical nozzle 72 having an axis 73. The axes 71 and 73 are generally convergent and are so orientated that they are closest to each other in a region, generally indicated at 74 in FIG. 5, which is at or just outside the outer cylindrical surface 57 of the piston. This region 74 will be called the mixing region. The two nozzles exit into a recess 75 which is machined into the outer surface 57. The recess is in the form of part of a cylinder, having a flat end wall 76 containing the outer end of the nozzle 72, and a cylindrical wall 77 containing the outer end of the nozzle 70. The mixing region 74 thus includes the space within the recess 75.

Figure 6:
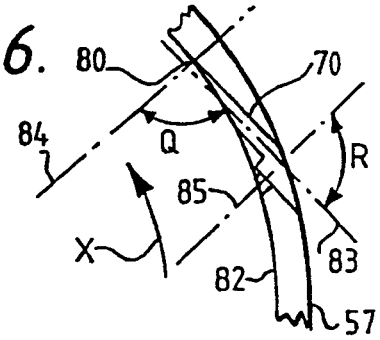
FIG. 6 is a diagram illustrating features of the geometry of the jet nozzles.

The nozzle 70 is drilled through the piston wall at an angle such that it is tangential at its inlet end to the bore 82 of the piston barrel 54, in the manner indicated at 80 in FIG. 6. A longitudinal plane 83 containing the axis 71 is therefore orthogonal to a longitudinally extending diametral plane 84 of the barrel 54 which contains the piston axis Y, FIG. 3, and which intersects the bore 82 at the point 80. In other words the angle Q, FIG. 6, is 90 degrees. The plane 83 is intersected by another longitudinal plane 85 containing the axis 73 of the second nozzle 72. The angle R between the planes 83 and 85 is 90 degrees in this example, but may have a value within the inclusive range 40 to 90 degrees.

In the rear set of nozzles 58, all the nozzle axes 71, 73 lie in the diametral plane 60. However, this need not be the case. Indeed, in the present example, it is not the case with the front nozzle set 59, in which the axes of each first nozzle 90 is offset so as to be skew with respect to the axis of the associated second nozzle 72, the latter being arranged in the same way as in the rear nozzle set 58. Thus in each nozzle pair 63 of the front set, the axis 91 of the nozzle 90 is offset by an angle S, FIG. 7, from the diametral plane 61 which intersects the mixing region 74 and which, in this example, also contains the axis of the second nozzle 72. The angle S is 45 degrees in this example, but may be of any desired value. The axes of the second nozzles 72 may also be offset so that these nozzles are directed somewhat forwardly, the relevant angle P (FIG. 4) being in the inclusive range 10 to 90 degrees between the axis of the nozzle 72 and the bore 82.

When water under pressure is introduced through the rear end of the piston 50, it is forced out through the nozzles 70, 72, 90. The first nozzles 70 and 90 are so orientated that the jets of water issuing from them set the piston in rotation about its axis Y. The direction of this rotation is indicated at X in FIG. 6. It will be realised that as this rotation takes place, the water within the barrel 54 tends to swirl in such a direction as to be forced tangentially into the nozzles 70 and 90.

In addition, some of the water passes out through the second nozzles 72, though at a generally lower flow rate than that passing through the first nozzles. The jets issuing from the first and second nozzles of each pair impinge on each other in the mixing region 74, thus causing a substantial amount of atomisation of the water.

FIG. 8 shows a typical application in connection with fire fighting, in which the water projected from tile spray gun of the invention is used as a fire shield. In FIG. 8, the fire is indicated at 32 and the water from the spray gun is again indicated at 47. A baffle 30 is fitted over the tube I to protect the fire fighter from the water itself.

FIGS. 9 to 11 show typical uses for a modified form of the spray gun, described below with reference to FIG. 12 and having a trepanning drill 15 fitted at its leading end.

FIG. 9 shows the use of this spray gun to extinguish a fire in an upper room 20 of a building, using an extension 21 coupled to an extension tube 2 and extending downwards to a fire engine or hydrant 22. In this example the hole 46 made by the drill 15 is through an outer wall over a window 23.

FIG. 10 shows the spray gun of FIG. 12 when used for extinguishing a fire in a loft 24, by drilling through the ceiling 25 of the room below.

FIG. 11 is a diagrammatic plan indicating a hotel room 26, entered through a narrow passage 27 via a door 28 from a corridor 29. In this case the drill 15 is used to drill through the door 28, and the spray gun is attached to a hose 45 through an extension tube 1' of the same diameter as the spray gun body 1. The piston spray head, 3, can thus be located in the middle of the room 26, so as to distribute water as evenly as possible.

Referring to FIG. 12, the rear end of the spray gun body 1 carries a coupling 2 which is adapted (by means not shown) conventionally for connection to the leading end of a fire hose, so that water under pressure is introduced into the tubular body 1. The latter has a carrying handle 49. The bore of the body 1 is smooth towards its leading end, which contains a hollow cylindrical spray head 3, generally similar to the spray head 50 already described with reference to FIGS. 3 to 7, and adapted as a piston as in FIG. 2. Further Jet nozzles 6 may be provided in the front end of the head 3 if required.

The head or piston 3 is coaxial with the body 1, and is freely rotatable on a coaxial shaft 8, itself rotatable and mounted in bearings 9 and 10 carried coaxially within the body 1. The shaft 8 is hollow, and open at both ends. It carries: a coupling 13 at its rear end; means, not shown, for connection to the pressurised water supply: and a nozzle 18 at its leading end, which projects some way forward from the front end of the body 1. The shaft 8 carries a thrust block 12, including a further bearing (not shown). The thrust block 12 bears against the front end of the piston 3. The coupling 13, which is only indicated diagrammatically, is of any suitable kind suitable for coupling the shaft 8 to a drive means, not shown, for rotating the shaft 8.

A head piece 14 is secured to the front end of the shaft B, and carries the cylindrical trepanning drill 15 having a drill tip 16, coaxially with the shaft 8 and extending forward of the Jet nozzle 18. The head piece 14 may incorporate a stop valve whereby water can be admitted at will to the nozzle 18, to be projected forward within the drill 15 as indicated at 48. A compression spring 19 is mounted around the shaft 8 between the head piece 14 and the thrust block 12. This spring biasses the piston 3 into the position shown in full lines, in which the piston 3 lies within the tubular spray gun body 1 so that its jet nozzles are protected against blockage by foreign matter.

In the event of fire in an enclosed space, such as a room in a wooden house, the drill tip 16 can be placed against a wall of the enclosure from outside. The drive means mentioned above is coupled to the shaft 8 by means of the coupling 13. For this purpose, a conventional electric drill of suitable power rating may be used. The shaft 8 is thus rotated, so that the drill 15 drills a hole through the wall, of a diameter substantially the same as that of the cylindrical body 1. The drill can be cooled while operating, by means of water introduced through the Jet nozzle 18, and as soon as the hole through the wall is completed, water will thereby be applied to the fire inside.

The spray gun body 1 is now introduced into the hole so as to lie within it, and full water pressure is applied to the rear end of the cylinder 1 so as to force the piston 3 forward and out, into the position indicated at 3' in phantom lines, in which its barrel 4 projects forward out of the cylinder 1 to expose the jet nozzles, in the same way as in FIG. 2.

The jet nozzles being so arranged as to cause the piston 3 to rotate about the shaft 8, water is thereby distributed, within the room, in nearly all directions, as indicated diagrammatically by the broken line envelope at 47. In addition, the jet nozzles are so arranged that the water is at least partly atomised. The body 1 can be led into the room as far as desired, for example by attaching a suitable extension to the coupling 2 and removing the handle 49.

Because the hole drilled through the wall is substantially the same as the outer diameter of the tube 1, additional air is not drawn through tile hole into the room.

The use of the drill 15 is optional, since the spray gun can of course be used in situations where it is not necessary to drill through a structural part such as a wall. The head piece 14 can then be without the drill.

Figure 5:
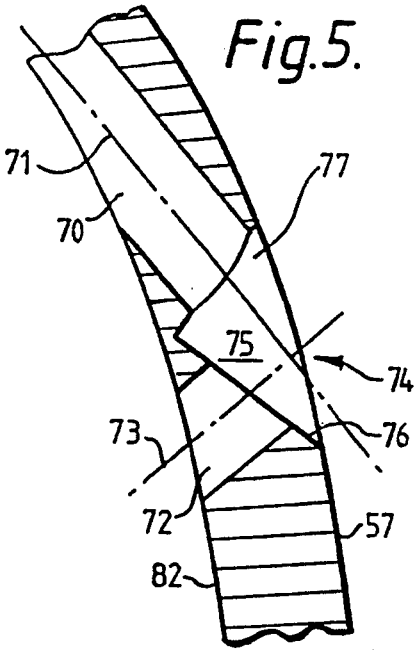
FIG. 5 is a scrap cross section on a much larger scale, taken on the line V—V in FIG. 3 and showing a group of jet nozzles.

Spray leads according to the invention may be used in many applications where a fine spray of water is required to be delivered in an essentially non-directional sense, i.e. substantially all around the spray head as exemplified at 47 in FIGS. 1 and 5. Their use is not confined to fire-fighting: they may be used in various processing applications. The liquid sprayed need not be water. Again, if hot water requiring to be cooled is discharged through the head, it will be rapidly cooled and can then be collected. The spray head can readily be adapted to deliver make-up water to a steam cooling tower or similar installation, the spray of water rapidly absorbing heat from the steam into which it is discharged.

We claim:

1. A spray gun, comprising:

mounting means:

a hollow, substantially cylindrical body having an upstream end adapted for connection to a high pressure liquid supply and a downstream end which is open and provided with said mounting means; and, a spray head for converting high pressure liquid into an enveloping atomized spray mist around said spray head, wherein said spray head comprises a hollow cylindrical shell having a barrel portion of circular cross-section, said mounting means mounting said spray head for rotation about its longitudinal axis, said spray head and said hollow body having cooperating bearing surfaces for sealing said spray head to said hollow body while permitting rotation of said spray head about its longitudinal axis, said spray head having means substantially closing said cylindrical shell ahead of said barrel portion and having an upstream end which is open for receiving high pressure liquid from within said hollow body, said barrel portion having groups of jet orifices arranged around its circumference and formed through its wall, each of said groups comprising at least two orifices having substantially convergent axes orientated so as to be closest to each other in a mixing region adjacent the outer cylindrical surface of said spray head, the axis of at least one orifice in each of said groups being orientated in a pre-determined circumferential direction for direction a jet of said liquid in said circumferential direction and for promoting rotation of said spray head about its axis, said outer cylindrical surface having a plurality of recesses formed therein, one of said recesses for each said group of orifices, the orifices of each group opening into the respective said recess whereby said recess consititutes at least part of the mixing region associated therewith.

2. The spray gun according to claim 1, wherein the orifices of each said group are arranged for passing liquid through them at different flow rates.

3. The spray gun according to claim 1, wherein said groups of orifices are arranged as a plurality of sets, each of said sets having a plurality of said groups distributed circumferentially around said barrel portion of said spray head, the groups of jet orifices in one set being offset circumferentially from the groups in a next adjacent set.

4. The spray gun according to claim 1, wherein at least one of said groups of orifices comprises orifices the axes of which are in a skew relationship to each other.

5. The spray gun according to claim 1, wherein at least one orifice has its axis inclined to a diametral plane that intersects the associated said recess.

6. The spray gun according to claim 1, wherein at least one said group of jet orifices comprises a first orifice orifice and a second orifice, the axis of the first orifice being substantially orthogonal to a diametral first axial plane so that the first orifice is substantially tangential to the bore of the barrel portion.

7. The spray gun according to claim 6, wherein the axis of the second orifice lies in a second plane, the angle (R) between the axis of the first orifice and the second plane being in the inclusive range of 40° to 90°.

8. The spray gun according to claim 6, wherein the axis of the second orifice is directly forwardly.

9. The spray gun according to claim 8, wherein the axis of the second orifice makes an angle (P) with the bore of the barrel portion in the inclusive range of 10° to 90°.

10. A spray gun, comprising:

mounting means;

a hollow, substantially cylindrical body having an upstream end adapted for connection to a high pressure liquid supply and a downstream end which is open and provided with said mounting means; and, a spray head for converting high pressure liquid into an enveloping atomized spray mist around said spray head, wherein said spray head comprises a hollow cylindrical shell having a barrel portion of circular cross-section, said spray head having internal first bearing means supporting said spray head on said mounting means adjacent an anterior end of said spray head and external second bearing means adjacent a posterior end of said spray head and engaged within the bore of said hollow body, said first bearing means and said second bearing means sealing said spray head to said hollow body while permitting rotation of said spray head about its longitudinal axis, said spray head having means substantially closing said cylindrical shell ahead of said barrel portion and having its posterior end open for receiving high pressure liquid from within said hollow body, said barrel portion having groups of jet orifices arranged around its circumference and formed through its wall, each of said groups comprising at least two orifices having substantially convergent axes orientated so as to be closest to each other in a mixing region adjacent an outer cylindrical surface of said spray head, and the axis of at least one orifice in each of said groups being non-radial.

11. The spray gun according to claim 10, wherein said mounting means and said hollow body are of such lengths that said spray head is movable, under the influence of pressure of said liquid from its posterior end, axially from a first position, substantially enclosed within said hollow body, to a second position projecting axially from said hollow body.

12. The spray gun according to claim 11, further comprising spring return means for moving said spray head from its said second position to its said first position.

13. The spray gun according to claim 10, wherein said mounting means comprises an elongate support member coaxial with said hollow body and of substantially circular cross-section.

14. The spray gun according to claim 13, wherein said elongate support member comprises a hollow tube adapted to direct some of said high pressure liquid forwardly beyond said spray head.

15. The spray gun according to claim 14, wherein said hollow tube carries a trepanning drill at its outer end.

* * * * *